US012612235B2

(12) United States Patent
Shachal et al.

(10) Patent No.: US 12,612,235 B2
(45) Date of Patent: Apr. 28, 2026

(54) AQUATIC PLANTS MIXING PACK

(71) Applicant: GreenOnyx LTD, Tel Aviv (IL)

(72) Inventors: Dubi Shachal, Rehovot (IL); Maya Dayan, Ramat-Gan (IL); Benjamin Shoham, Gany-Tikvah (IL)

(73) Assignee: GreenOnyx LTD, Tel Aviv (IL)

( * ) Notice: Subject to any disclaimer, the term of this patent is extended or adjusted under 35 U.S.C. 154(b) by 53 days.

(21) Appl. No.: 18/702,654

(22) PCT Filed: Oct. 18, 2022

(86) PCT No.: PCT/IB2022/060022
§ 371 (c)(1),
(2) Date: Apr. 18, 2024

(87) PCT Pub. No.: WO2023/067511
PCT Pub. Date: Apr. 27, 2023

(65) Prior Publication Data

US 2025/0002242 A1 Jan. 2, 2025

Related U.S. Application Data

(60) Provisional application No. 63/257,359, filed on Oct. 19, 2021.

(51) Int. Cl.
*B65D 81/32* (2006.01)
*B65D 65/46* (2006.01)
(Continued)

(52) U.S. Cl.
CPC ..... *B65D 81/3266* (2013.01); *B65D 65/466* (2013.01); *B65D 75/5883* (2013.01);
(Continued)

(58) Field of Classification Search
CPC ..... B65D 65/466; B65D 75/5883; B65D 81/3266; B65D 85/52; B65D 2565/388; B65D 2575/586
(Continued)

(56) References Cited

U.S. PATENT DOCUMENTS 3,478,871 A 11/1969 Sager
3,749,620 A 7/1973 Montgomery
(Continued)

FOREIGN PATENT DOCUMENTS

EP 1008524 B1 6/2006
WO 2016/201492 A1 12/2016
WO 2017020038 A1 2/2017

OTHER PUBLICATIONS

International Search Report issued in International Application No. PCT/IB2022/060022, mailed Jan. 9, 2023, 3 pages.
(Continued)

*Primary Examiner* — Luan K Bui
(74) *Attorney, Agent, or Firm* — Sterne, Kessler, Goldstein & Fox P.L.L.C.

(57) ABSTRACT

A flexible multi-compartment package is provided. The package may include a first compartment that contains aquatic plants and a second compartment that contains a carrier material. The first compartment and the second compartment may be fluidly coupled via a channel disposed between the first compartment and the second compartment. The channel may be unsealed to allow fluid communication between the first compartment and the second compartment such that the aquatic plants and carrier material may be mixed for consumption.

19 Claims, 5 Drawing Sheets

(51) Int. Cl.
*B65D 75/58* (2006.01)
*B65D 85/52* (2006.01)

(52) U.S. Cl.
CPC ..... *B65D 85/52* (2013.01); *B65D 2565/388* (2013.01); *B65D 2575/586* (2013.01)

(58) Field of Classification Search
USPC ..... 206/219–221
See application file for complete search history.

(56) References Cited

U.S. PATENT DOCUMENTS 4,994,056 A * 2/1991 Ikeda ..... A61J 1/2093 604/87
5,171,683 A * 12/1992 Kertz ..... C12M 23/24 47/84
5,257,985 A * 11/1993 Puhl ..... A61J 1/2093 604/408
6,968,948 B2 * 11/2005 Scott ..... B65D 85/52 47/84
7,717,257 B1 * 5/2010 Lu ..... B65D 81/3266 206/451
8,056,726 B2 * 11/2011 Huff ..... B65D 81/3266 206/568
2005/0087456 A1 4/2005 Oka et al.
2005/0087457 A1 * 4/2005 Schmidt ..... B65D 81/3266 206/219
2014/0140166 A1 * 5/2014 Smith ..... B65D 33/1666 206/221
2014/0248436 A1 * 9/2014 Awbery-Maskell ..... B65D 81/3266 206/221
2016/0023834 A1 1/2016 DiLiberto
2021/0269213 A1 9/2021 Burley et al.

OTHER PUBLICATIONS

Written Opinion of the International Searching Authority issued in International Application No. PCT/IB2022/060022, mailed Jan. 9, 2023, 6 pages.

* cited by examiner

AQUATIC PLANTS MIXING PACK

FIELD

Embodiments described herein generally relate to a multi-compartment package. In particular, embodiments relate to a package having compartments to separately store consumables and allow for mixing of the consumables and consumption.

BACKGROUND

Packages may be utilized to easily fill, transport, and dispense a consumable to a user. These packages may have a compartment containing a desired consumable, such as a beverage. An end of these packages may be designed to dispense and facilitate consumption of the consumable. Users may desire consumables comprising a variety of ingredients having different quality control requirements. Accordingly, a need exists for packaging desired consumables while maintaining quality.

BRIEF SUMMARY

Some embodiments are directed to a flexible multi-compartment package. The flexible multi-compartment package may include a first compartment containing aquatic plants, a second compartment containing a carrier material, a channel fluidly coupling the first compartment and the second compartment, and a seal releasably sealing the channel.

In some embodiments, the channel may accelerate the flow of the aquatic plants and the carrier material flowing through the channel.

In some embodiments, a wall of the first compartment may include a material having an oxygen permeability of greater than or equal to 30 $cm^3m^{-2}$ day-1 measured according to ASTM D3985 at 23° C. and 0% relative humidity. In some embodiments, a wall of the second compartment may include a material having a second oxygen permeability less than the first oxygen permeability.

In some embodiments, the flexible multi-compartment package may further include a second seal disposed across an opening of the first compartment or the second compartment. In some embodiments, the second seal may be a resealable seal.

In some embodiments, the flexible multi-compartment package may further include a cap configured to close an opening of the first compartment or an opening of the second compartment.

In some embodiments, the flexible multi-compartment package may fold along a fold line disposed across a width of the channel. In some embodiments, the flexible multi-compartment package may be folded along the fold line into a folded position, where, in the folded position, a wall of the second compartment is in contact with a wall of the first compartment. In some embodiments, the flexible multi-compartment package may be unfolded along the fold line into an unfolded position, where, in the unfolded position, the second compartment is disposed below the first compartment.

In some embodiments, in a first position, the seal may prevent fluid communication between the first compartment and the second compartment, and, in a second position, the seal allows fluid communication between the first compartment and the second compartment. In some embodiments, the seal may include a rotating clip configured to rotate between the first position and the second position. In some embodiments, the rotating clip may be rotatably coupled to the package at a first end of the clip. In some embodiments, the rotating clip may include a groove configured to close the channel when the package is in the closed position. In some embodiments, the seal may include a rupturable seal.

In some embodiments, the flexible multi-compartment package may further include a first inner seal and a second inner seal, where the channel is disposed between the first inner seal and the second inner seal. In some embodiments, the first inner seal may include a first edge and the second inner seal may include a second edge, where the first and second edges define a width of the channel, and where the width of the channel varies along a length of the channel.

In some embodiments, the channel may include a minimum width ranging from 1 centimeter to 2 centimeters.

In some embodiments, the flexible multi-compartment package may be biodegradable.

In some embodiments, the flexible multi-compartment package may be sterile.

In some embodiments, the first compartment may include a first fill volume and the second compartment comprise a second fill volume, and wherein a ratio of the first fill volume to the second fill volume is between 1 to 6 and 1 to 0.1.

Some embodiments are directed to a flexible package for containing aquatic plants, The flexible multi-compartment package may include a first compartment containing the aquatic plants and comprising a wall having an oxygen permeability of greater than or equal to 30 $cm^3m^{-2}$ day-1 measured according to ASTM D3985 at 23° C. and 0% relative humidity, a second compartment containing a carrier material and comprising a wall having a second oxygen permeability less than the first oxygen permeability, a channel fluidly coupling the first compartment and the second compartment, and a seal releasably sealing the channel. The seal may include a rotating clip that may to rotate between a first position and a second position, where, in the first position, the clip is configured to prevent fluid communication between the first compartment and the second compartment, and, in the second position, the clip allows fluid communication between the first compartment and the second compartment.

BRIEF DESCRIPTION OF THE DRAWINGS

Some features herein are illustrated by way of example, and not by way of limitation, in the accompanying drawings. In the drawings, like numerals reference similar elements between the drawings.

DETAILED DESCRIPTION

Figure 1:
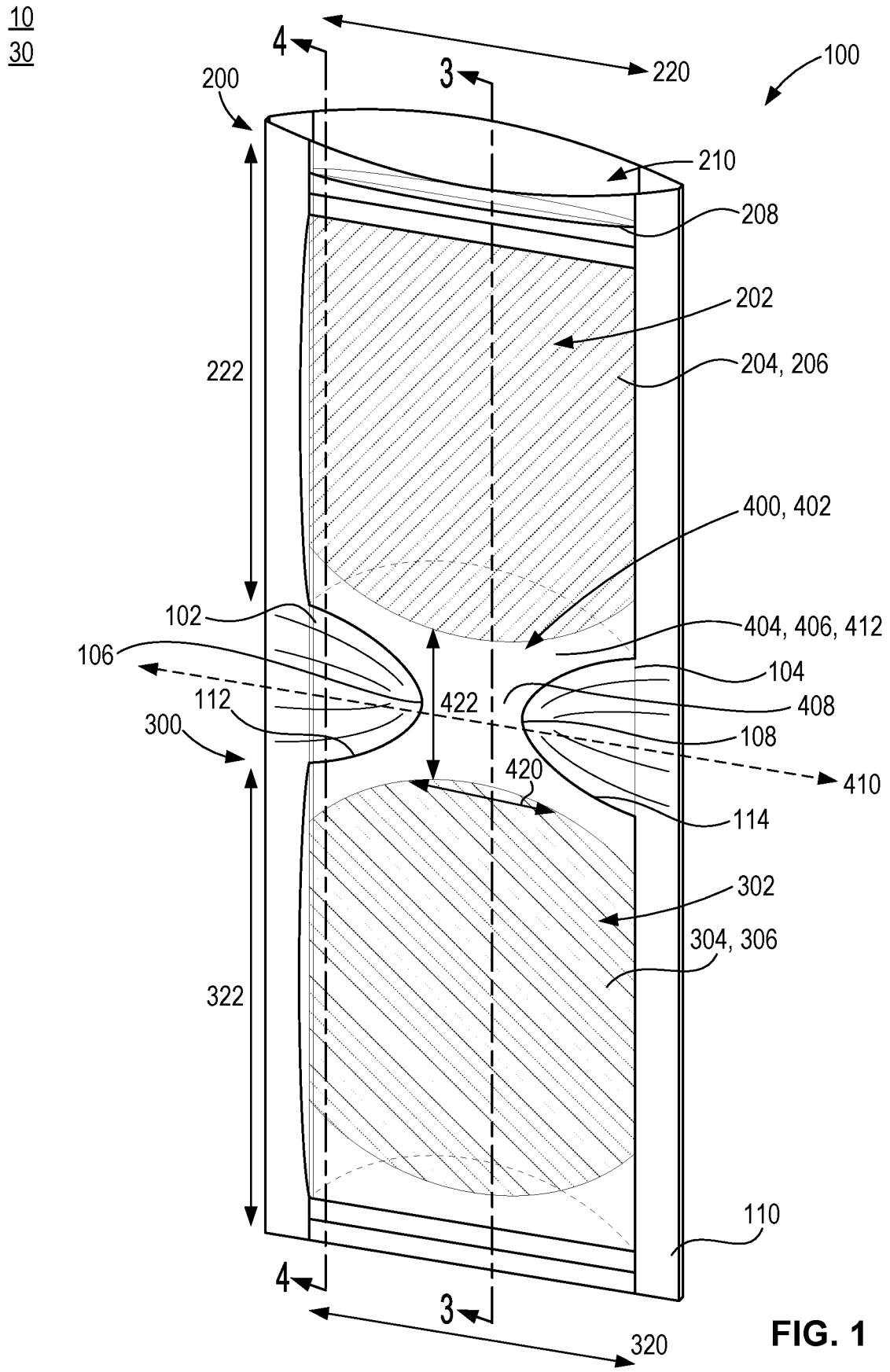
FIG. 1 illustrates a package in an unfolded position according to some embodiments.

Embodiments of the present disclosure are described in detail herein with reference to embodiments thereof as illustrated in the accompanying drawings, in which like reference numerals are used to indicate identical or functionally similar elements. References to "one embodiment," "an embodiment," "some embodiments," "in certain embodiments," etc., indicate that the embodiment described can include a particular feature, structure, or characteristic, but every embodiment can not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Desired beverages or other non-solid consumable products may comprise natural ingredients, such as ingredients having fruits, vegetables, seeds (e.g., cereals and legumes), and aquatic plants. Packages described herein may provide users with these consumables having natural ingredients and may provide adequate containment, preparation, and dispensing. Some consumable, for example a consumable comprising aquatic plant ingredients, may benefit from a breathable package designed with one or more oxygen permeable portions. The package described herein may allow ingredients, such as the aquatic plants to breathe within the package while maintaining the quality of other ingredients that should not be exposed to significant oxygen within the package.

Packages described herein may include multiple, individual compartments to separate different ingredients of the desired consumable. One compartment may contain one or more natural ingredient, for example, aquatic plants. Another compartment may include a carrier material. The carrier material may mix with the natural ingredient(s) to create the desired consumable for consumption by the user. Carrier materials may include yogurt, tahini, dressing, or a beverage, for example. Additionally, in some embodiments, the carrier material may be sufficiently viscous to facilitate mixing with the natural ingredients. The carrier material may mix with the natural ingredients to create a consumable with higher nutrition. In this way, the carrier material may be an "add on" to enhance the flavor of the natural ingredient having the desired nutrients. The packages described herein may be suitable for aquatic plants. Examples of aquatic plants include but are not limited to, algae or a plant from the Lemnaceae family (Duckweed), such as Spirodela plants, Landoltia plants, *Lemna* plants, Wolffiella plants, or Wolffia plants.

In some embodiments, the packages may include a seal along a channel that separates the individual compartments such that the natural ingredients and the carrier material are prevented from being in fluid communication. When a user desires the consumable, they may remove the seal or cause the seal to be ruptured to fluidly couple the compartments of the package via the channel. This may allow fluid communication between the individual compartments so that the natural ingredients and carrier material may flow through the channel and mix within the package. User application of a force on the package and compartments thereof may cause mixing of the natural ingredients with the carrier material to create the desired consumable. An opening at an end of the packages may allow dispensing and consumption of the desired consumable.

By initially separating the ingredients of the desired consumable, the individual compartments may be designed for particular ingredients. For example, the compartment containing a natural ingredient may be made, in whole or in part, of a material having a relatively high gas permeability to allow significant passage of gases (for example, oxygen and carbon dioxide) in and out of the compartment. In some embodiments, the compartment containing the carrier material may include a material having a relatively low gas permeability to prevent significant passage of gases (for example, oxygen and carbon dioxide) in and out of the compartment. In some embodiments, because the compartments contain consumables, the compartments may be made of a non-toxic and/or a sterilized material.

The packages described herein may be desirable for users who desire highly nutritious and transportable consumables that are quickly accessible. These users may include children participating in sports activities or adults who are highly active during the day, for example. Storing each component at its individual optimal condition prior to consumption may significantly increase package shelf life.

Another contemplated application is outer space, where users may also require storable consumables where nutrients are preserved and quality is maintained. Additionally, the systems and methods described herein may allow fresh green leaves, such as duckweed, to be safely consumed without generating debris, such as crumbs. Embodiments contemplated for use in outer space can be used in zero gravity environments, for example on a space station or a space shuttle. Embodiments for use in zero gravity environments may include no readily detachable components and potential generation of crumbs. For example, embodiments for use in zero gravity environments may include a channel seal having a rotating clip secured to the package for reversibly sealing a channel of the package. Embodiments with no readily detachable components may be particularly desirable for zero gravity environments because these embodiments may limit the amount of potential floating debris within such environments.

FIG. 1 illustrates a package 100 according to some embodiments. Package 100 may include a first compartment 200, a second compartment 300, and a channel 400. First compartment 200 may contain one or more natural ingredients. For example, in some embodiments, first compartment 200 may contain one or more ingredients having fruits, vegetables, seeds (e.g., cereals and legumes), and aquatic plants. In some embodiments, first compartment 200 may contain aquatic plants. Second compartment 300 may contain one or more carrier materials. Exemplary carrier materials contained in second compartment include, but are not limited to a yogurt, tahini, dressing, or a beverage.

First compartment 200 and second compartment 300 may include a first fill volume and a second fill volume, respectively. In some embodiments, the ratio of the first fill volume to the second fill volume may be between 1 to 6 and 1 to 0.1. As shown in FIG. 1, channel 400 may be disposed between first compartment 200 and second compartment 300. Channel 400 may fluidly couple first compartment 200 and second compartment 300.

First compartment 200 may include a first cavity 202 and a first wall 204. First wall 204 may define all or a portion of the volume of first cavity 202 and include a first material 206. The one or more natural ingredients contained in first compartment 200 may be disposed in first cavity 202. In some embodiments, first material 206 may be a material having a relatively high gas permeability such that it is a low gas barrier material. For example, first material 206 may allow for passage of one or more of oxygen, carbon dioxide, or nitrogen. A relatively high gas permeability may be beneficial for some ingredients, for example aquatic plants, which benefit from being able to breathe within first cavity 202. In some embodiments, first material 206 may have an oxygen permeability of greater than or equal to 30 $cm^3m^{-2}$ $day^{-1}$ measured according to ASTM D3985 at 23° C. and 0% relative humidity. In some embodiments, first material 206 may have an oxygen permeability of greater than or equal to 100 $cm^3m^{-2}$ $day^{-1}$ measured according to ASTM D3985 at 23° C. and 0% relative humidity. In some embodiments, first material 206 may include 180 micron thick PE (polyethylene).

Second compartment 300 may include a second cavity 302 and a second wall 304. Second wall 304 may define all or a portion of the volume of second cavity and include a second material 306. The one or more carrier materials contained in second compartment 300 may be disposed in second cavity 302. In some embodiments, second material 306 may be a material having a relatively low gas permeability such that it is a high gas barrier material. For example, second material 306 may prevent or inhibit passage of one or more of oxygen, carbon dioxide, or nitrogen. A relatively low gas permeability may be beneficial for some ingredients, for example, a carrier material that may lose quality if exposed to significant external gases (for example, oxygen) while within second compartment 300. In some embodiments, second material 306 may include, for example, 12 micron thick PET (polyethylene terephthalate), 12 micron thick HB PET (high-barrier PET), or 100 micron thick PE.

In some embodiments, second material 306 may be a material having an oxygen permeability less than the oxygen permeability of first material 206. In some embodiments, second material 306 may be a material having an oxygen permeability less than 30 $cm^3m^{-2}$ $day^{-1}$ measured according to ASTM D3985 at 23° C. and 0% relative humidity. In some embodiments, second material 306 may be a material having an oxygen permeability less than 100 $cm^3m^{-2}$ $day^{-1}$ measured according to ASTM D3985 at 23° C. and 0% relative humidity. In some embodiments, second material 306 may be a material having an oxygen permeability at least 5% less than the oxygen permeability of the first material 206, with both oxygen permeabilities measured according to ASTM D3985 at 23° C. and 0% relative humidity.

Channel 400 may include a third cavity 402 and a third wall 404. Third wall 404 may be made of a third material 406. A surface 412 of channel 400 may define a flow path for one or more ingredients or one or more carrier materials to flow through channel 400 during use. Third wall 404 may enclose and define third cavity 402. In some embodiments, third material 406 may be a material having an oxygen permeability that is between the oxygen permeability of first material 206 and the oxygen permeability second material 306.

In some embodiments, surface 412 of channel 400 may be smooth to facilitate flow through channel 400 of the natural ingredients and carrier material. In such embodiments, surface 412 may include a low surface roughness. In some embodiments, a surface roughness average (Ra) of surface 412 may range from 0.10 microns to 0.20 microns, including subranges. For example, in some embodiments, the surface roughness average may range from 0.15 microns to 0.20 microns, 0.10 microns to 0.18 microns, 0.10 microns to 0.16 microns, 0.10 microns to 0.14 microns, or 0.10 microns to 0.12 microns, or within a range having any two of these values as endpoints.

As shown for example in FIG. 1, package 100 may have an unfolded position 10. In unfolded position 10, second compartment 300 may be disposed below first compartment 200.

In some embodiments, package 100 may include a channel seal 408 for releasably sealing channel 400. In some embodiments, channel seal 408 may be a resealable seal. For example, in some embodiments, channel seal 408 may include a zipper or press seal to alternately seal and unseal channel seal 408. In some embodiments, channel seal 408 may be a rupturable seal. In some embodiments, a rupturable channel seal 408 may not be resealable. In some embodiments, channel seal 408 may include a rupturable seal. In some embodiments, first compartment 200 and second compartment 300 are separated by channel seal 408 when channel seal 408 is in a sealed state.

Figure 2:
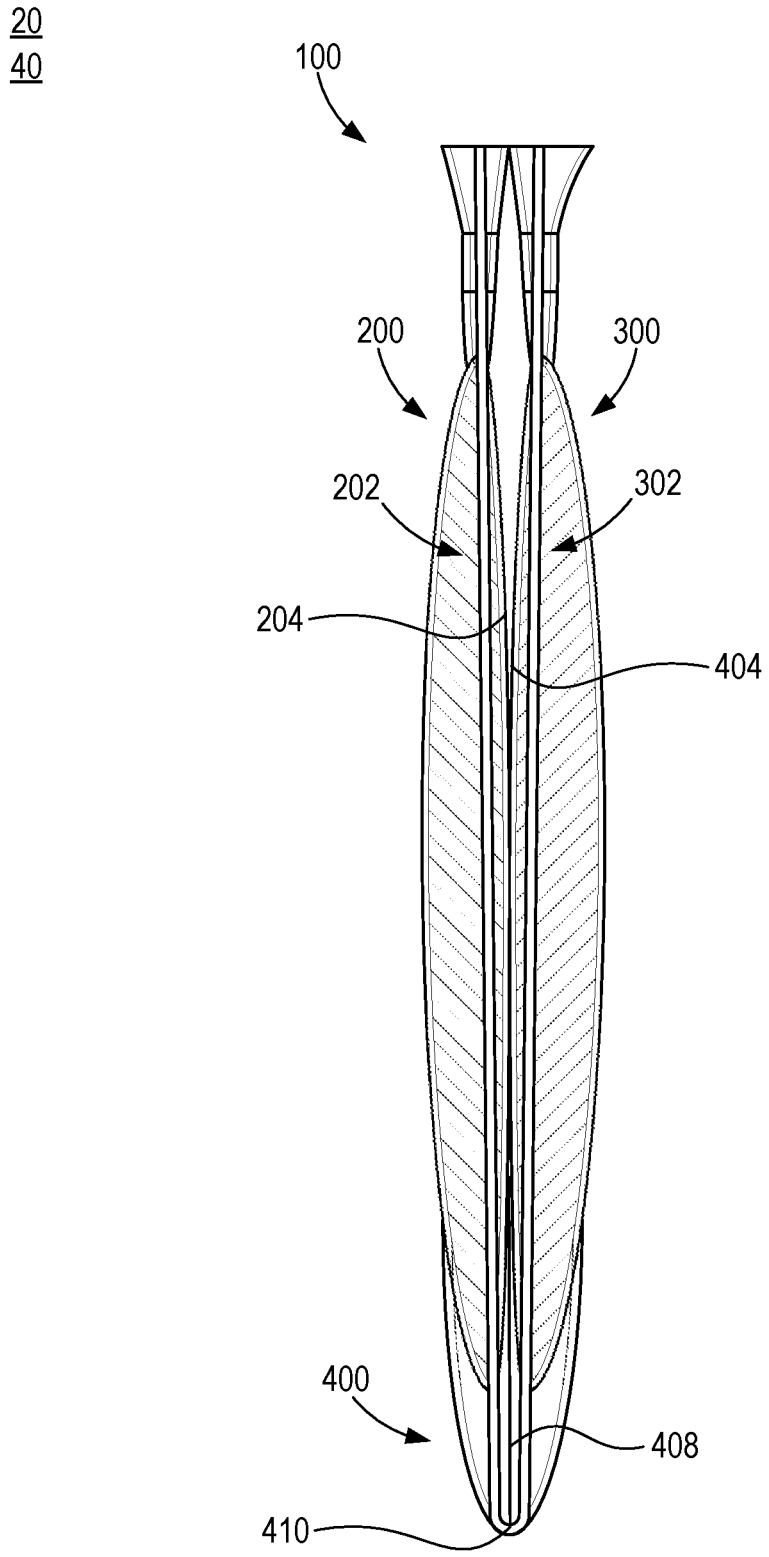
FIG. 2 illustrates the package of FIG. 1 in a folded position.

By unsealing channel seal 408, channel 400 may be unobstructed to allow the flow of one or more ingredients or one or more carrier materials through channel 400. When channel seal 408 is unsealed, package 100 may be in an open position 30. In some embodiments, package 100 may be in open position 30 only in unfolded position 10. In some embodiments, package 100 may be in open position 30 also when in a folded position 20 (FIG. 2).

As discussed above, first compartment 200 and second compartment 300 may be fluidly coupled via channel 400. Accordingly, in open position 30, first compartment 200 and second compartment 300 may be in fluid communication because channel 400 is unsealed (e.g., unobstructed). Accordingly, in a first position, channel seal 408 may prevent fluid communication between first compartment 200 and second compartment 300. In a second position, channel seal 408 may allow fluid communication between first compartment 200 and second compartment 300.

By user application of force on package 100 (e.g., on first compartment 200, second compartment 300, or first compartment 200 and second compartment 300), the one or more natural ingredients of first compartment 200 and the one or more carrier materials of second compartment 300 may be mixed. During mixing, the natural ingredients and carrier material may flow through channel 400. In this way, the natural ingredients of first compartment 200 may flow to second compartment 300, and the carrier material of second compartment 300 may flow to first compartment 200, and vice versa. The flow may create a mixed consumable in package 100 for consumption by the user.

In some embodiments, first compartment 200 may include an opening 210. Opening 210 may allow dispensing of the mixed natural ingredient(s) of first compartment 200 and carrier material(s) of second compartment 300. By user application of force on package 100 (e.g., on first compartment 200, second compartment 300, or first compartment 200 and second compartment 300), the mixture may be dispensed through opening 210 for consumption by the user. In some embodiments, user application of force on package 100 (e.g., on first compartment 200, second compartment 300, or first compartment 200 and second compartment 300), causes flow of ingredient(s) and carrier material(s) from second compartment 300 to first compartment 200 and through opening 210.

In some embodiments, an opening seal 208 may be disposed on first compartment 200. Opening seal 208 may be disposed across opening 210 and unsealed to allow the mixture to be dispensed through opening 210 for consumption by the user. In some embodiments, opening seal 208 may be a resealable seal. For example, opening seal 208 may include a zipper or press seal to alternately seal and unseal opening 210. In such embodiments, package 100 may be reusable. In some embodiments, opening seal 208 may be a rupturable seal. A rupturable opening seal 208 may not be resealable. In such embodiments, package 100 may be designed for one-time use. In some embodiments, opening seal 208 may be a cap, for example cap 600.

In some embodiments, second compartment 300 may additionally or alternatively include an opening the same as opening 210. In such embodiments, second compartment 300 may include an opening seal the same as opening seal 208. In some embodiments, opening seal 208 may be disposed across opening 210 of first compartment 200 or an opening of second compartment 300.

Package 100 may include a first inner seal 102, a second inner seal 104, and an outer edge 110. First inner seal 102, second inner seal 104, and outer edge 110 may selectively close space within package 100. Accordingly, package 100 is sealed along its edge via outer edge 110 to prevent outward flow from first compartment 200 and second compartment 300. Similarly, package 100 may be sealed at first inner seal 102 and second inner seal 104 to prevent flow through these portions of package 100 between first compartment 200 and second compartment 300.

In some embodiments, channel 400 may be disposed between first inner seal 102 and second inner seal 104. In some embodiments, channel 400 may be disposed between a first edge 106 of first inner seal 102 and a second edge 108 of second inner seal 104. In such embodiments, first edge 106 and second edge 108 may define a minimum width 420 of channel 400.

In some embodiments, first edge 106 may be curved. In some embodiments, first edge 106 may include a first radius of curvature 112. In some embodiments, first radius of curvature 112 may extend along the entirety of first edge 106. In other words, first edge 106 may comprise a curved surface having a constant or variable first radius of curvature 112 along its entire length. In some embodiments, first radius of curvature 112 may extend partially along first edge 106 and a reminder of first edge 106 may be flat. In some embodiments, second edge 108 may be curved. In some embodiments, second edge 108 may include a second radius of curvature 114. In some embodiments second radius of curvature 114 may extend along the entirety of second edge 108. In other words, second edge 108 may comprise a curved surface having a constant or variable second radius of curvature 114 along its entire length. In some embodiments, second radius of curvature 114 may extend partially along second edge 108 and a reminder of second edge 108 may be flat.

In some embodiments, a width of channel 400 may vary along a length 422 of channel 400. In such embodiments, a varying width of channel 400 may accelerate flow of the natural ingredient(s) and carrier material(s) through channel 400. For example, channel 400 may accelerate the flow of aquatic plants and carrier material flowing through channel 400. In some embodiments, minimum width 420 of channel 400 may be narrow such that upon user action of force on package 100 (e.g., on first compartment 200, second compartment 300, or first compartment 200 and second compartment 300), flow of the carrier material through channel 400 from second compartment 300 to first compartment 200 may be accelerated. In such embodiments, a narrower width of channel 400 in comparison to second compartment 300, for example, may create a flow path that may be accelerated. In such embodiments, the narrow width of channel 400 may require a higher velocity flow to maintain a flow rate from second compartment 300 having a larger area. The acceleration may be caused by second compartment 300 having a higher fluid pressure and channel 400 having a lower fluid portion, which results in a net force that drives the fluid toward and through channel 400. In some embodiments, accelerating the flow of the carrier material(s) through channel 400 from second compartment 300 to first compartment 200 may minimize backflow of material to second compartment 300.

First compartment 200 may have a first width 220. In some embodiments, first width 220 may range from 2 cm (centimeters) to 6 cm, including subranges. For example, in some embodiments, first width 220 may range from 2 cm to 6 cm, 2 cm to 5.5 cm, 2 cm to 5 cm, 2 cm to 4.5 cm, 2 cm to 4 cm, 2 cm to 3.5 cm, 2 cm to 3 cm, or 2 cm to 2.5 cm, or within a range having any two of these values as endpoints.

First compartment 200 may have a first length 222. In some embodiments, first length 222 may range from 2 cm to 10 cm, including subranges. For example, in some embodiments, first length 222 may range from 2 cm to 10 cm, 2 cm to 9 cm, 2 cm to 8 cm, 2 cm to 7 cm, 2 cm to 6 cm, 2 cm to 5 cm, 2 cm to 4 cm, or 2 cm to 3 cm, or within a range having any two of these values as endpoints.

Second compartment 300 may have a second width 320. In some embodiments, second width 320 may range from 2 cm to 6 cm, including subranges. For example, in some embodiments, second width 320 may range from 2 cm to 6 cm, 2 cm to 5.5 cm, 2 cm to 5 cm, 2 cm to 4.5 cm, 2 cm to 4 cm, 2 cm to 3.5 cm, 2 cm to 3 cm, or 2 cm to 2.5 cm, or within a range having any two of these values as endpoints.

Second compartment 300 may have a second length 322. In some embodiments, second length 322 may range from 2 cm to 10 cm, including subranges. For example, in some embodiments, second length 322 may range from 2 cm to 10 cm, 2 cm to 9 cm, 2 cm to 8 cm, 2 cm to 7 cm, 2 cm to 6 cm, 2 cm to 5 cm, 2 cm to 4 cm, or 2 cm to 3 cm, or within a range having any two of these values as endpoints.

Channel 400 may have a minimum width 420. Minimum width 420 may be the narrowest width of channel 400. In other words, minimum width 420 may be the smallest lateral distance measured between first edge 106 of first inner seal 102 and second edge 108 of second inner seal 104. In some embodiments, minimum width 420 may range from 1 cm to 4 cm, including subranges. For example, in some embodiments, minimum width 420 may range from 1 cm to 4 cm, 1 cm to 3.5 cm, 1 cm to 3 cm, 1 cm to 2.5 cm, 1 cm to 2 cm, or 1 cm to 1.5 cm, or within a range having any two of these values as endpoints.

In some embodiments, length 422 of channel 400 may range from 2 cm to 5 cm, including subranges. For example, in some embodiments, length 422 may range from 2 cm to 5 cm, 2 cm to 4.5 cm, 2 cm to 4 cm, 2 cm to 3.5 cm, 2 cm to 3 cm, or 2 cm to 2.5 cm, or within a range having any two of these values as endpoints.

Package 100 and components thereof (e.g., first compartment 200 and second compartment 300) may be flexible. Accordingly, package 100 may be a flexible, multi-compartment package. In some embodiments, package 100 may be reusable. In some embodiments, package 100 may be disposable. In some embodiments, package 100 may be biodegradable. In some embodiments, because package 100 contains consumables, package 100 may be non-toxic. In some embodiments, package 100 may be sterile. In some embodiments, package 100 may be made under aseptic processing. Package 100 may be sterilized by processes used in food packaging that may use chemicals, light, and/or high pressure (for example, gamma radiation, heat pasteurization, and/or HPP (High Pressure Processing). Common methods to determine whether a package 100 is sterile include performing bacterial and fungal total count in a sample from package 100. In some embodiments, an unfilled package 100 may be sterilized, for example by gamma irradiation, before aquatic plants and carrier material are added to the compartments of package 100. The aquatic plants may be grown and stored prior to packing under sterile conditions. Additionally, the carrier material may be processed, for example by pasteurization, before packaging under sterile conditions. In some embodiments, package 100 may be filled under sterile conditions in a sterile environment. Aquatic plants and carrier material may be inserted into its individual, separate compartment under controlled conditions by using sterile tools under a hood, for example. The separate compartments for aquatic plants and carrier material can maintain the sterility of each component until mixing and consumption, ensuring food safety and long shelf life.

In some embodiments, package 100 may be wide such that user action applying force to mix the natural ingredients of first compartment 200 and the carrier material of second compartment 300 may require using one or more hands. In some embodiments, package 100 may be narrow such that user action applying force to mix the natural ingredients of first compartment 200 and the carrier material of second compartment 300 may require using one hand (e.g., the user's thumb and another finger).

As shown for example in FIG. 2, package 100 may have a folded position 20. Package 100 may be folded along fold line 410 into folded position 20. In folded position 20, first wall 204 of second compartment 300 may be in contact with second wall 304 of first compartment 200. In folded position 20, package 100 may fold along a fold line 410 disposed across minimum width 420 of channel 400. Conversely, package 100 may be unfolded along fold line 410 into unfolded position 10. In unfolded position 10, second compartment 300 may be disposed below first compartment 200. In some embodiments, fold line 410 may be a structural component of package 100. For example, fold line 410 may be a structurally weak region of package 100. In some embodiments, fold line 410 may not be a structural component of package 100, rather fold line 410 may be an imaginary axis about which package 100 may fold.

As discussed above, channel seal 408 of channel 400 may be sealed. Accordingly, channel 400 may be obstructed such that package 100 is in a closed position 40. In some embodiments, package 100 may be in closed position 40 in folded position 20. In some embodiments, package 100 may be in closed position 40 also when in unfolded position 10 (e.g., if channel seal 408 of channel 400 remains sealed when package 100 is unfolded to unfolded position 10).

Figure 3:
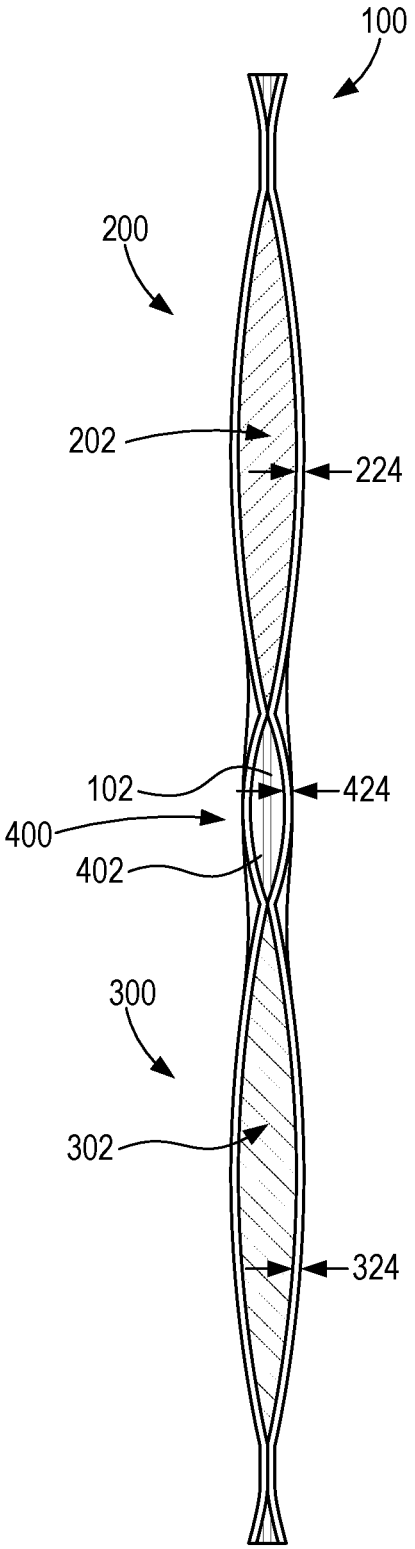
FIG. 3 illustrates the package of FIG. 1 along line 3-3.

As shown for example in FIG. 3, first wall 204 of first compartment 200 has a wall thickness 224. In some embodiments, wall thickness 224 may range from 10 microns to 200 microns, including subranges. For example, in some embodiments, wall thickness 224 may range from 10 microns to 200 microns, 10 microns to 190 microns, 10 microns to 180 microns, 50 microns to 150 microns, or 90 microns to 110 microns, or within a range having any two of these values as endpoints.

Second wall 304 of second compartment 300 has a wall thickness 324. In some embodiments, wall thickness 324 may range from 10 microns to 200 microns, including subranges. For example, in some embodiments, wall thickness 224 may range from 10 microns to 200 microns, 10 microns to 190 microns, 10 microns to 180 microns, 50 microns to 150 microns, or 90 microns to 110 microns, or within a range having any two of these values as endpoints.

Third wall 404 of channel 400 has a wall thickness 424. In some embodiments, wall thickness 424 may range from 10 microns to 200 microns, including subranges. For example, in some embodiments, wall thickness 224 may range from 10 microns to 200 microns, 10 microns to 190 microns, 10 microns to 180 microns, 50 microns to 150 microns, or 90 microns to 110 microns, or within a range having any two of these values as endpoints.

In some embodiments, wall thickness 224, wall thickness 324, and/or a wall thickness 424 as described herein may minimize the amount of material (e.g., first material 206) that may be contaminated, thereby facilitating the creation of a sterile package 100.

Figure 4:
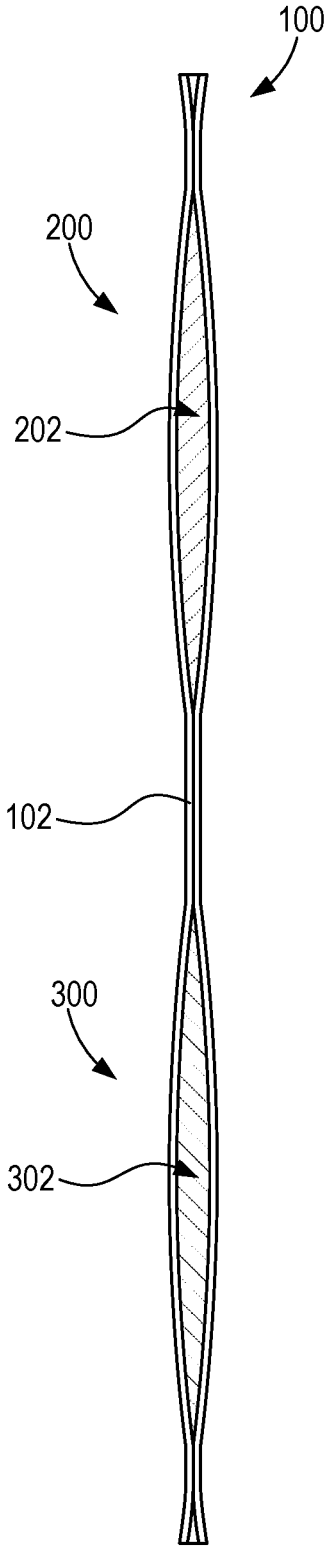
FIG. 4 illustrates the package of FIG. 1 along line 4-4.

As shown for example in FIGS. 3-4, channel 400 includes a third cavity 402 adjacent to first inner seal 102 and second inner seal 104. As discussed above, while channel 400 allows flow of natural ingredient(s) of first compartment 200 and the carrier material(s) of second compartment 300, package 100 may be sealed at first inner seal 102 and second inner seal 104 to prevent flow through these portions of package 100 between first compartment 200 and second compartment 300. In such embodiments, first inner seal 102 and second inner seal 104 may be configured to funnel natural ingredient(s) of first compartment 200 and the carrier material(s) of second compartment through channel 400 when a user applies a force on package 100 (e.g., on first compartment 200, second compartment 300, or first compartment 200 and second compartment 300).

Figure 5:
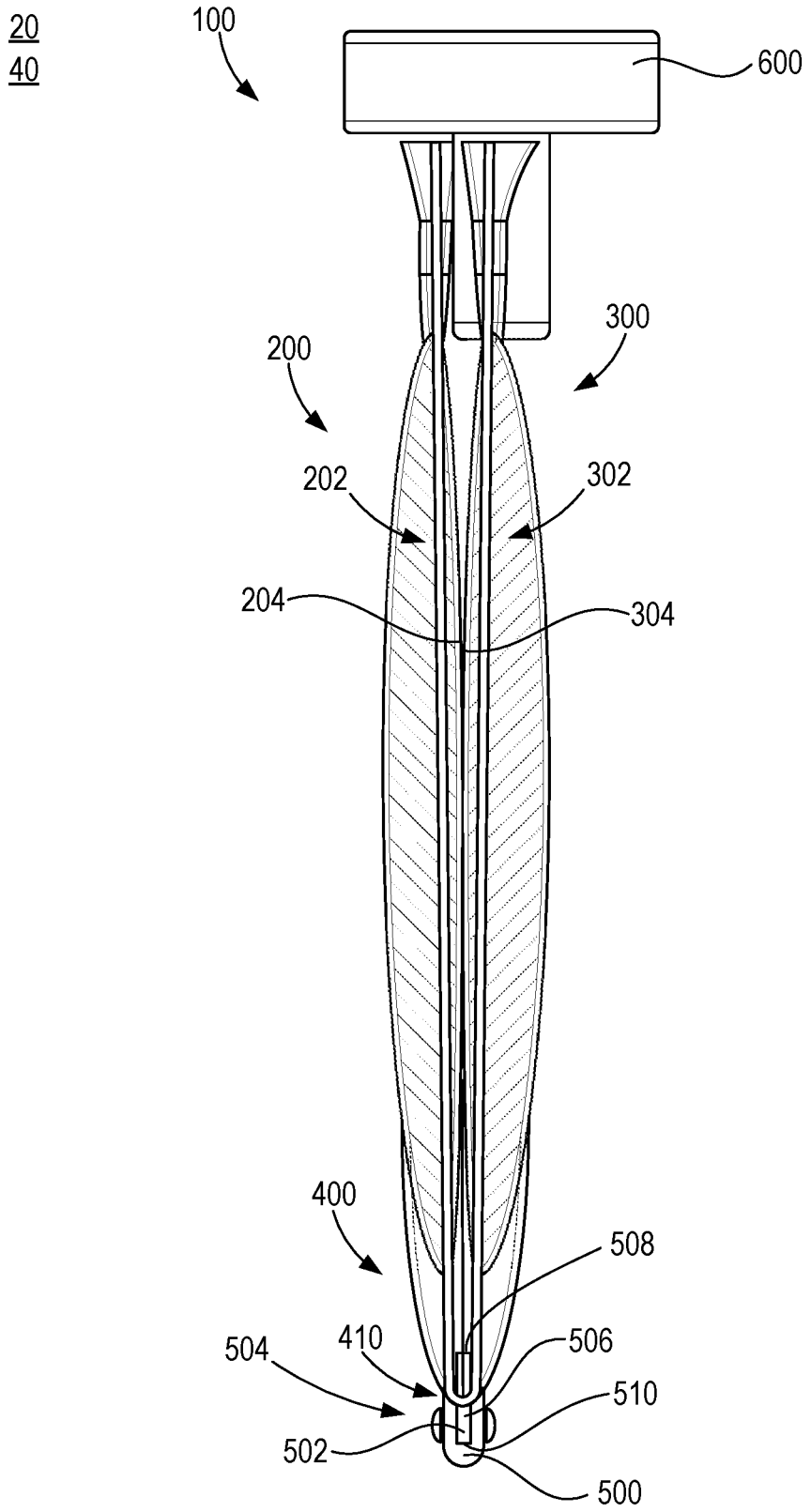
FIG. 5 illustrates a package in a folded position according to some embodiments.

FIG. 5 illustrates package 100 in folded position 20 according to some embodiments. As shown in FIG. 5, in some embodiments, package 100 may include a clip 500 having a first end 502, a second end 504, a top portion 508, and a bottom portion 510. In some embodiments, clip 500 may include a groove 506 formed in top portion 508 or bottom portion 510. In some embodiments, groove 506 of clip 500 may be a channel that extends between first end 502 and second end 504 and between top portion 508 and bottom portion 510 of clip 500. In some embodiments, package 100 may include a cap 600.

In some embodiments, cap 600 may be disposed across opening 210 on first compartment 200 to alternately open and close opening 210. Accordingly, removing cap 600 may allow access to opening 210 such that the contained mixture may be dispensed through opening 210 for consumption by the user. In this way, package 100 may be reusable.

In some embodiments, package 100 may include both cap 600 and opening seal 208 (FIG. 1). In some embodiments, package 100 may include opening seal 208 and no cap 600. In some embodiments, cap 600 may close opening 210 of first compartment 200 or an opening of second compartment 300. In some embodiments, opening seal 208 may close opening 210 of first compartment 200 or an opening of second compartment 300. In some embodiments, an opening of second compartment 300 may have the same configuration as opening 210 of first compartment 200 (e.g., opening of second compartment 300 may have an opening seal that may include a zipper or press seal to alternately seal and unseal opening 210).

In some embodiments, channel seal 408 may include clip 500, which may be a rotating clip 500. In such embodiments, clip 500 may rotate between the first position in which channel seal 408 may prevent fluid communication between first compartment 200 and second compartment 300 and the second position in which channel seal 408 may allow fluid communication between first compartment 200 and second compartment 300. For example, clip 500 may fasten around (e.g., pinch) channel 400 such that channel 400 is obstructed and package 100 is in closed position 40.

In such embodiments, clip 500 may rotate to move package 100 between open position 30 and closed position 40. In some embodiments, package 100 may be retained in closed position 40 via clip 500. For example, first end 502 and second end 504 may be disposed on either side of channel 400 (e.g., adjacent first inner seal 102 and second inner seal 104) and third wall 404 of channel 400 may be pinched between top portion 508 and bottom portion 510 of clip 500. In some embodiments, groove 506 may receive channel 400 when package 100 is in closed position 40. For example, first end 502 and second end 504 may be disposed on either side of channel 400 (e.g., adjacent first inner seal 102 and second inner seal 104) and groove 506 may be positioned across channel 400 to receive third wall 404 to pinch third wall 404 between top portion 508 and bottom portion 510 of clip 500.

Figure 6:
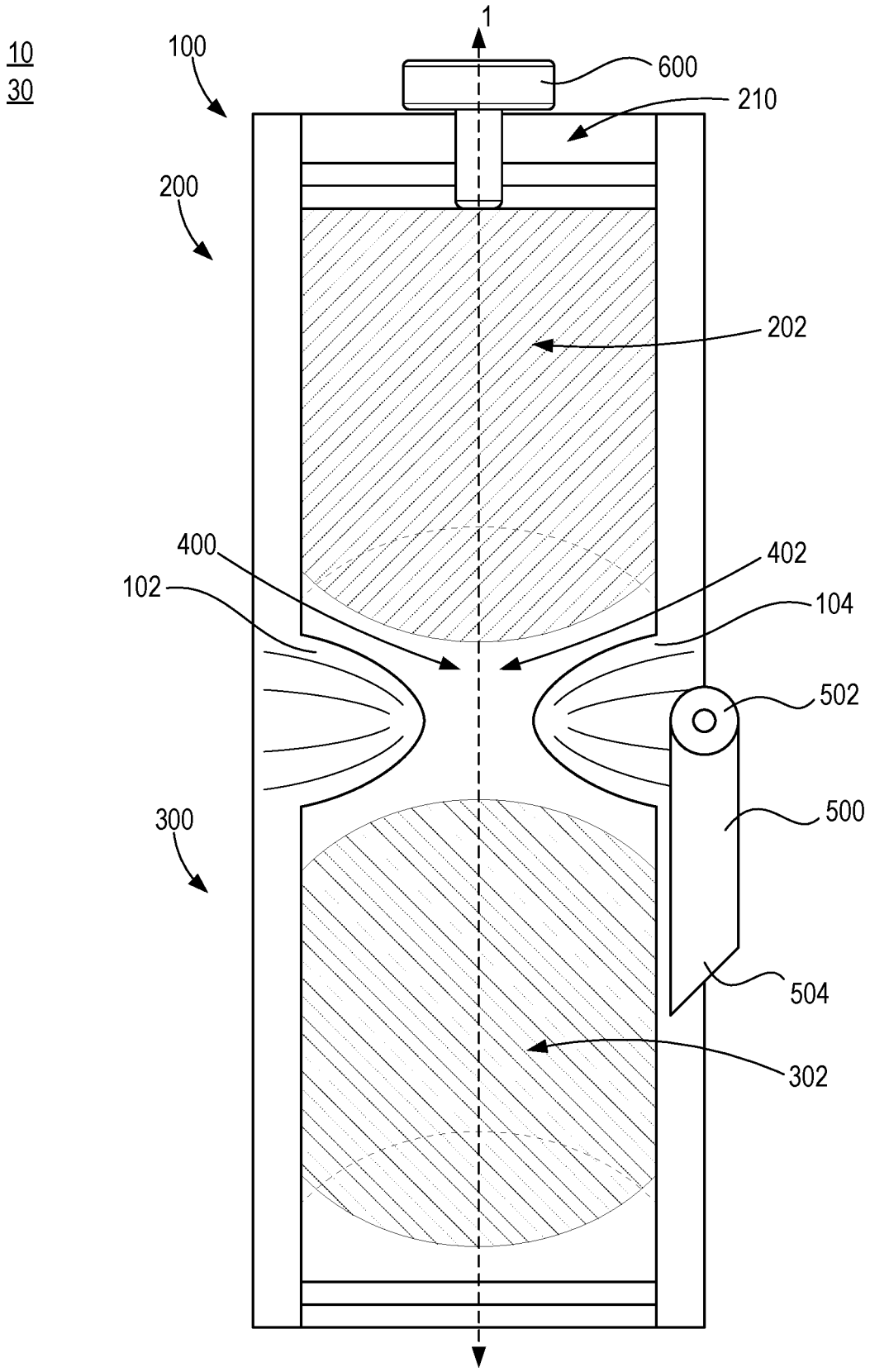
FIG. 6 illustrates the package of FIG. 5 in an unfolded position.

In some embodiments, first end 502 of clip 500 may be coupled to package 100. With reference to FIG. 6, in some embodiments, clip 500 may be rotatably coupled to package 100 at first end 502 of clip 500. In some embodiments, clip 500 may be rotated inwardly toward axis 1 to close package 100 in closed position 40 (FIG. 5).

As shown for example in FIG. 6, in unfolded position 10, clip 500 may be rotated outwardly away from an axis 1 such that package 100 is in open position 30. A user may rotate clip 500 via second end 504, which may be a free end. In this way, clip 500 may unseal channel 400 such that channel 400 is unobstructed. Accordingly, package 100 may be in open position 30 when clip 500 is rotated to unseal channel 400.

Axis 1 may extend longitudinally along a length of package 100. In some embodiments, axis 1 may be a central longitudinal axis of package 100 extending through a center of channel 400. In some embodiments, cap 600 may be disposed along axis 1 such that it is centrally located across opening 210 of first compartment 200. In some embodiments, cap 600 may be disposed adjacent to axis 1 such that it is offset from central axis 1. In such embodiments, opening 210 may be offset from central axis 1 a mixed consumable may be dispensed off-center through opening 210 for consumption by the user.

While various embodiments have been described herein, they have been presented by way of example, and not limitation. It should be apparent that adaptations and modifications are intended to be within the meaning and range of equivalents of the disclosed embodiments, based on the teaching and guidance presented herein. It therefore will be apparent to one skilled in the art that various changes in form and detail can be made to the embodiments disclosed herein without departing from the spirit and scope of the present disclosure. The elements of the embodiments presented herein are not necessarily mutually exclusive, but can be interchanged to meet various situations as would be appreciated by one of skill in the art.

The indefinite articles "a," "an," and "the" include plural referents unless clearly contradicted or the context clearly dictates otherwise.

The term "comprising" is an open-ended transitional phrase. A list of elements following the transitional phrase "comprising" is a non-exclusive list, such that elements in addition to those specifically recited in the list can also be present. The phrase "consisting essentially of" limits the composition of a component to the specified materials and those that do not materially affect the basic and novel characteristic(s) of the component. The phrase "consisting of" limits the composition of a component to the specified materials and excludes any material not specified.

Where a range of numerical values comprising upper and lower values is recited herein, unless otherwise stated in specific circumstances, the range is intended to include the endpoints thereof, and all integers and fractions within the range. It is not intended that the disclosure or claims be limited to the specific values recited when defining a range. Further, when an amount, concentration, or other value or parameter is given as a range, one or more ranges, or as list of upper values and lower values, this is to be understood as specifically disclosing all ranges formed from any pair of any upper range limit or value and any lower range limit or value, regardless of whether such pairs are separately disclosed.

It is to be understood that the phraseology or terminology used herein is for the purpose of description and not of limitation. The breadth and scope of the present application should not be limited by any of the above-described exemplary embodiments, but should be defined only in accordance with the following claims and their equivalents.

What is claimed is:

1. A flexible multi-compartment package, comprising:
- a first compartment containing aquatic plants;
- a second compartment containing a carrier material;
- a channel fluidly coupling the first compartment and the second compartment; and
- a seal releasably sealing the channel,
- wherein, in a first position, the seal is configured to prevent fluid communication between the first compartment and the second compartment, and wherein, in a second position, the seal allows fluid communication between the first compartment and the second compartment, and
- wherein the seal comprises a rotating clip configured to rotate between the first position and the second position.

2. The flexible multi-compartment package of claim 1, wherein the channel is configured to accelerate the flow of the aquatic plants and the carrier material flowing through the channel.

3. The flexible multi-compartment package of claim 1, wherein a wall of the first compartment comprises a material having an oxygen permeability of greater than or equal to 30 $cm^3m^{-2}$ $day^{-1}$ measured according to ASTM D3985 at 23° C. and 0% relative humidity.

4. The flexible multi-compartment package of claim 3, wherein a wall of the second compartment comprises a material having a second oxygen permeability less than the first oxygen permeability.

5. The flexible multi-compartment package of claim 1, further comprising:
- a second seal disposed across an opening of the first compartment or the second compartment.

6. The flexible multi-compartment package of claim 5, wherein the second seal is a resealable seal.

7. The flexible multi-compartment package of claim 1, further comprising:
- a cap configured to close an opening of the first compartment or an opening of the second compartment.

8. The flexible multi-compartment package of claim 1, wherein the package is configured to fold along a fold line disposed across a width of the channel.

9. The flexible multi-compartment package of claim 8, wherein the package is configured to be folded along the fold line into a folded position, and wherein, in the folded position, a wall of the second compartment is in contact with a wall of the first compartment.

10. The flexible multi-compartment package of claim 8, wherein the package is configured to be unfolded along the fold line into an unfolded position, and wherein, in the unfolded position, the second compartment is disposed below the first compartment.

11. The flexible multi-compartment package of claim 1, wherein the rotating clip is rotatably coupled to the package at a first end of the clip.

12. The flexible multi-compartment package of claim 1, wherein the rotating clip comprises a groove configured to close the channel when the package is in the closed position.

13. The flexible multi-compartment package of claim 1, wherein the package further comprises:

a first inner seal; and a second inner seal, wherein the channel is disposed between the first inner seal and the second inner seal.

14. The flexible multi-compartment package of claim 13, wherein the first inner seal comprises a first edge and the second inner seal comprises a second edge, wherein the first and second edges define a width of the channel, and wherein the width of the channel varies along a length of the channel.

15. The flexible multi-compartment package of claim 1, wherein the channel comprises a minimum width ranging from 1 centimeters to 2 centimeters.

16. The flexible multi-compartment package of claim 1, wherein the package is biodegradable.

17. The flexible multi-compartment package of claim 1, wherein the package is sterile.

18. The flexible multi-compartment package of claim 1, wherein the first compartment comprises a first fill volume and the second compartment comprise a second fill volume, and wherein a ratio of the first fill volume to the second fill volume is between 1 to 6 and 1 to 0.1.

19. A flexible package for containing aquatic plants, the package comprising:

a first compartment containing the aquatic plants and comprising a wall having an oxygen permeability of greater than or equal to 30 $cm^3m^{-2}$ $day^{-1}$ measured according to ASTM D3985 at 23° C. and 0% relative humidity;

a second compartment containing a carrier material and comprising a wall having a second oxygen permeability less than the first oxygen permeability;

a channel fluidly coupling the first compartment and the second compartment; and a seal releasably sealing the channel, the seal comprising a rotating clip configured to rotate between a first position and a second position, wherein, in the first position, the clip is configured to prevent fluid communication between the first compartment and the second compartment, and wherein, in the second position, the clip allows fluid communication between the first compartment and the second compartment.

* * * * *